US006873138B2

(12) United States Patent
Jacobson

(10) Patent No.: US 6,873,138 B2
(45) Date of Patent: Mar. 29, 2005

(54) METHOD AND APPARATUS FOR CONVERTING POWER

(75) Inventor: Boris Solomon Jacobson, Westford, MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/393,059

(22) Filed: Mar. 20, 2003

(65) Prior Publication Data

US 2004/0257272 A1 Dec. 23, 2004

(51) Int. Cl.[7] ..... G05F 1/40
(52) U.S. Cl. ..... 323/235; 232/284
(58) Field of Search ..... 323/222, 282, 323/284, 235, 252, 276, 277, 288; 363/39, 56.03, 56.04, 56.12

(56) References Cited

U.S. PATENT DOCUMENTS

| | | | | |
|---|---|---|---|---|
| 3,740,640 A | | 6/1973 | Ravas et al. | 323/17 |
| 4,319,246 A | | 3/1982 | Fitz | 343/17.1 R |
| 4,677,367 A | * | 6/1987 | Goodman | 323/222 |
| 4,691,270 A | | 9/1987 | Pruitt | 363/56 |
| 4,737,899 A | | 4/1988 | Lorec | 363/24 |
| 4,814,770 A | | 3/1989 | Reger | 342/175 |
| 4,855,888 A | | 8/1989 | Henze et al. | 363/17 |
| 4,876,635 A | | 10/1989 | Park et al. | 363/17 |
| 5,023,634 A | | 6/1991 | Nishioka et al. | 342/368 |
| 5,065,300 A | | 11/1991 | Jacobson et al. | 363/16 |
| 5,151,852 A | | 9/1992 | Jacobson et al. | 363/131 |
| 5,264,736 A | | 11/1993 | Jacobson | 307/246 |
| 5,278,748 A | | 1/1994 | Kitajima | 363/56 |
| 5,602,554 A | | 2/1997 | Cepas et al. | 342/368 |
| 5,834,925 A | | 11/1998 | Chesavage | 323/272 |
| 6,108,526 A | | 8/2000 | van der Plas | 455/78 |
| 6,181,295 B1 | | 1/2001 | Sharaiha et al. | 343/895 |
| 6,396,714 B2 | | 5/2002 | Kato | 363/17 |
| 6,424,552 B1 | | 7/2002 | Jacobson | 363/154 |

OTHER PUBLICATIONS

B. Jacobson and R. DiPerna, "Series Resonant Converter with Clamped Tank Capacitor Voltage", Raytheon Company, Sudbury, MA 01776, IEEE APEC, 1990, pp. 137–146.
Christopher B. Basso, ON Semiconductor—ECN, Mar. 1, 2002, "New Solutions for Reducing Standby Power Drain in Electronic Products", http://www.e–insite.net/ecnmag/index.asp?layout=article&articleid=CA203952 Feb. 10, 2003, pp. 1–4.

(Continued)

*Primary Examiner*—Jessica Han
(74) *Attorney, Agent, or Firm*—Chapin & Huang, L.L.C.; David E. Huang, Esq.

(57) ABSTRACT

A power converter provides power to a phased-array radar antenna system. The converter adjusts its internal zero-voltage switching current so that it efficiently provides a clean power signal over a wide range of potential loads. More specifically, the zero-voltage switching current is increased in response to a decrease in load. The zero-voltage switching current in the converter can be maintained based on use of the same control signals that are otherwise used to regulate (via switching) the voltage output of the converter.

37 Claims, 9 Drawing Sheets

OTHER PUBLICATIONS

Polykom– "Zero–Voltage Switching Power MOSFETs", Electronicsnews.com.au, .NET vs J2EE, http://www.dialelectronics.com.au/articles/72/0c012872.asp, Feb. 10, 2003, pp. 1–2.

Igor Goryanskey "Zero–Voltage Switching Quasi Square Wave Converters", Cinema & Photo Research Institute (NIKFI), Moscow, Russia, Power Designers, http://-www.powerdesigners.com/InfoWeb/design_center/articles/ZVS%20Converters/zero_vol . . . , Jan. 7, 2003, pp. 1–12.

"Pulse Width Modulation (PWM) Basics", Power Designers, http://www.powerdesigners.com/InfoWeb/design_center/articles/PWM/pwm.shtm, Jan. 7, 2003, pp. 1–4.

J.A. Sabate, V. Vlatkovic, R.B. Ridley, P.C. Lee and B.II. Cho, "Design Considerations for High–Voltage High–Power Full–Bridge Zero–Voltage–Switched PWM Converter", Virginia Power Electronics Center The Bradley Department of Electrical Engineering Virginia Polytechnic Institute and State University Blacksburg, Virginia 24061, IEEE 1990, pp. 275–284, no month.

B. Jacobson and R. DiPerna, "Design of a Series Resonant Converter with Clamped Capacitor Voltage and Anti Cross-Conduction Inductors", IEEE 1998, pp. 829–833, no month.

* cited by examiner

METHOD AND APPARATUS FOR CONVERTING POWER

BACKGROUND OF THE INVENTION

Power supplies that deliver power to phased array radar systems must comply with stringent standards. Otherwise, unwanted deviations such as spikes, noise and ripple on the output voltage of the power supply will cause radar system failures. The requirements for clean power are even more stringent for applications in which the phased array antenna system operates asynchronously with respect to the radar's PRF (Pulse Repetition Frequency).

In order to comply with the stringent power supply requirements required by phased array radar systems, manufacturers can include extra circuitry in DC/DC power converter circuits so that they provide cleaner power signals.

One technique to provide cleaner power signals involves the use of filters. For example, specifically designed and strategically placed filters sometimes can be used to eliminate unwanted deviations on the output voltage of a power supply.

Another technique to provide cleaner power on the output of power converters is the use of conventional snubber circuits. In general, a snubber circuit incorporated in a DC/DC power converter is used to reduce power dissipation in semiconductors during switching operation. More specifically, in power converters that operate with phase-shift control, an inductor is sometimes connected across legs of a DC/DC converter to produce a snubber current that reduces losses during "turn on" switching transitions.

SUMMARY

Unfortunately, there are additional deficiencies associated with the aforementioned approaches to improving the operating characteristics of power supply devices and, more specifically, power converters. For example, the use of conventional filters to reduce excessive noise on the output of a power converter can be cost or weight prohibitive, especially for megawatt power subsystem applications. Thus, even though conventional filters may be effective, their use may be impractical.

Use of a conventional snubber circuit to reduce noise or ripple on the output voltage of a power converter circuit also has drawbacks. For example, conventional snubber circuits typically produce snubber currents that decrease proportionally as the output load is reduced. This reduction in snubber current typically results in unacceptable ripple and noise on the output of the power converter device at low load conditions. Use of such a power converter device incorporating conventional snubber circuits is therefore limited because they can only be used to drive heavier loads.

Another undesirable artifact associated with conventional snubber circuits is reduced power conversion efficiency. For example, during heavier loads and while generating increased snubber current, a greater portion of input power will be dissipated by the power converter device instead of being delivered to an intended load. Ideally, power conversion efficiency should be near 100% so that little or no power is consumed by the converter itself.

One aspect of the present invention involves providing zero-voltage switching in a power converter device even during relatively low output load conditions. To achieve this end, an electronic circuit such as a compensation circuit of a switching power supply device automatically generates a zero-voltage switching current that increases as an output load is reduced. As a result of extending zero-voltage switching to low load conditions, a power converter device provides a cleaner output voltage signal and maintains high efficiency over the full load range and therefore is well-suited for use in a wider variety of applications.

A power converter device according to certain principles of the present invention includes an input for receiving power from a power source. The received power is fed to a switching circuit that switches the received power based on time-varying control signals. In general, a main power switching circuit regulates the output voltage so that it is maintained within a specified range. To generate a cleaner output voltage signal, the compensation circuit associated with the main power switching circuit generates an increasing zero-voltage switching current in response to a reduction in load. Adjustment of the zero voltage switching current based on load deviation ensures that the output voltage of the converter is maintained within the specified range.

In one application, the zero-voltage switching current of the power converter is increased to maintain the output voltage in a specified range at times when the load is being reduced and the load is less than approximately twenty percent of a maximum potential load value. One technique for ensuring proper low-noise, high efficiency operation is to generate the zero voltage switching current using a feed-forward signal that varies depending on a load condition. Other suitable circuit configurations in addition to the feed-forward type signal also can be used.

The power converter device can include power transistor switches that expose or electrically connect a transformer winding to different voltage polarities. For example, a first set of switches can be used to couple a transformer to a specific voltage polarity while a second set of switches can be used to couple the transformer to a voltage of opposite polarity. The effect of properly switching the voltage across windings of the transformer and rectifying the transformer output results in an output voltage that is regulated within a specified range.

The compensation circuit that is used to generate zero voltage switching current can be fabricated using discrete electronic components. For instance, the compensation circuit that produces zero voltage switching current optionally includes a passive element such as an inductor that is coupled to the main power switching circuit. Auxiliary switches in the compensation circuit couple the inductor to different power references (voltage references) so that the zero-voltage switching current from the inductor is automatically controlled. The auxiliary switches and inductor amount to relatively minimal extra circuitry, but provide compensation current such as ZVS current for producing a cleaner output power signal.

The auxiliary switches coupled to the inductor are optionally controlled by at least a portion of the time-varying control signals that are also used to control a set of main power switching transistors. Supporting common use of control signals for the different switching circuits reduces the complexity of a controller that would otherwise have to generate extra control signals to drive the auxiliary switches.

In one application, the power converter is a clamped mode series resonant converter device. However, the techniques according to the principles of the present invention can be employed in any suitable power supply device or electronic circuit application.

In another embodiment of the present invention, a power converter circuit includes a first power switching circuit disposed in parallel to a second power switching circuit that, in combination, produce an output voltage for powering a load. A compensation circuit couples the first power switching circuit to the second power switching circuit. The compensation circuit generates a zero voltage switching current that varies depending on load deviation. In this embodiment, the power converter circuits combine to form a dual clamped-mode series resonant DC/DC converter. Zero-voltage switching can be generated for a full range of potential output load conditions.

In yet another more specific embodiment, the power converter device is a DC/DC voltage converter that converts an input voltage to an output voltage that powers an electronic device. Generally, an input power source provides input DC voltage to the power converter. In turn, the power converter generates a DC output voltage to drive a load such as a radar antenna subsystem. To maintain a low noise output voltage, the power converter automatically adjusts zero-voltage switching current as a result of load deviation. For example, while the output voltage drives the load, the power converter adjusts a zero-voltage switching current in an opposite direction than the change in load. Thus, the power converter increases zero-voltage switching current in response to a decrease in load, and is decreases zero-voltage switching current in response to an increase in load.

In another embodiment of the invention, the zero-voltage switching circuit or compensation circuit includes an inductor coupled to the converter circuit and a set of auxiliary switches open and close to generate the zero-voltage switching current from the inductor. In this embodiment, the auxiliary switches can be switching transistors having a smaller die size than main power switching transistors of the power converter.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views.

DETAILED DESCRIPTION

One aspect of the present invention is to adjust a compensation current such as a zero-voltage switching (ZVS) current in a power converter so that the converter produces a cleaner power signal and maintains high efficiency over the full load range. As previously discussed in the summary, a power converter increases a zero-voltage switching current in response to a reduced (or decreasing) load condition.

This technique of adjusting zero-voltage switching current is used so that sufficient zero-voltage switching current is produced at low load conditions, during which minimal power is delivered by the converter to power the load. A cleaner power signal (low noise, ripple, etc.) is produced at light loads due to increased zero-voltage switching. The generation of lower noise and output ripple voltage throughout a load range enables the power supply to operate with the burden of having to synchronize with the radar's PRF.

At heavier loads, the power converter reduces the zero-voltage switching current. Consequently, efficiency of the power converter does not suffer dramatically from excess zero-voltage switching current at heavy loads. A deficiency of conventional power converters at heavier loads is lower efficiency resulting from excessive zero-voltage switching current.

Since the power converter according to the principles of the present invention can operate at low load conditions and provide higher efficiency at heavier loads (and even lighter loads), such a converter can be used in a wider variety of applications than conventional converters.

Figure 1:
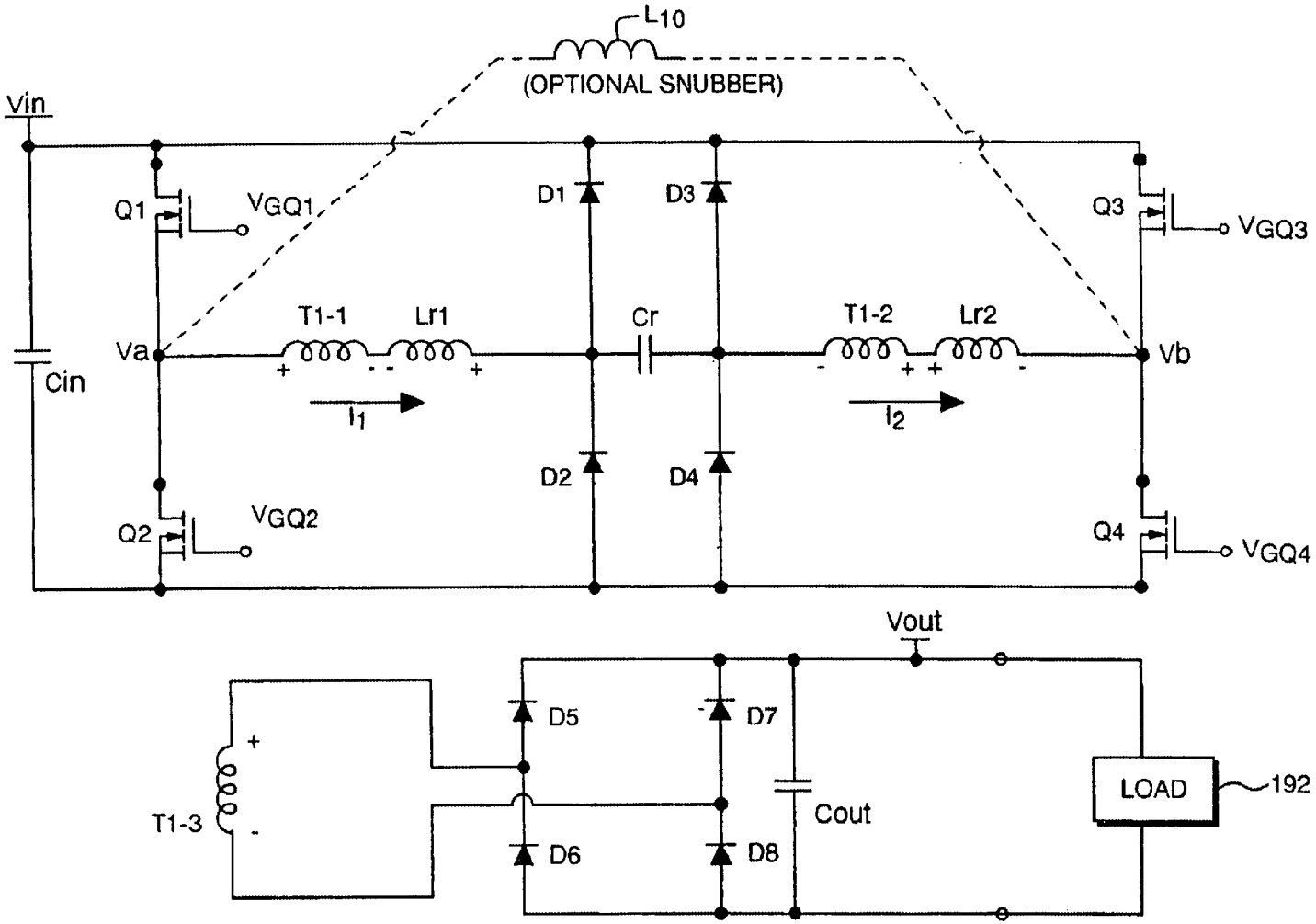
FIG. 1 PRIOR ART
FIG. 1 is a schematic diagram illustrating a conventional power converter device including a snubber circuit.

FIG. 1 is a schematic diagram of a conventional clamped-mode series resonant converter with clamped capacitor voltage and conventional ZVS snubber circuit. As previously discussed, conventional snubber circuits have been used to improve the output voltage of power converter devices.

In the circuit as shown in FIG. 1, the conventional snubber circuit is inductor L10, which generates a ZVS current that increases proportionally as the load 192 of the power converter 190 increases. That is, as the load 192 increases and more current is drawn from power converter circuit 190 to power the load 192, the conventional snubber circuit L10 produces more snubber current. At low load conditions such as at 25% or less of a maximum load condition, the snubber (or ZVS) current produced by L10 is so small that the output signal, Vout, can include unacceptable voltage spikes and noise. Accordingly, the conventional snubber circuit L10 provides snubber current when least needed (i.e., at high loads) and minimal snubber current when most needed (i.e., at low loads).

In addition to poor voltage output quality at low loads, reactive currents typically flow through the power converter circuit 190 regardless whether it is a heavy or light load. For example, and as previously discussed, the snubber circuit produces proportionally higher snubber current for heavier loads. As a result, the snubber circuit reduces converter efficiency at heavier loads.

To produce an output voltage, Vout, an electronic controller associated with power converter 190 produces the switching signals that drive corresponding gates of switching transistors Q1, Q2, Q3 and Q4. Typically, the switching transistors are driven with the fixed frequency phase-shift timing control signals such as those shown in FIG. 2.

Using the fixed frequency phase-shift timing control signals, transistors Q1 and Q2 are alternately switched on and off based on an approximate 50% duty cycle. Similarly, transistors Q3 and Q4 are alternately switched on and off based on an approximate 50% duty cycle. By switching transistors in the power converter circuit 190, the polarity of voltage across transformer winding T1-1 and T1-2 is alternated to produce a voltage on the output transformer winding T1-3, which is subsequently rectified by bridge, namely, diodes D5, D6, D7 and D8.

The electronic controller generating the timing control signals delays turning on transistor Q4 with respect to transistor Q1 by an angle $\phi$. Likewise, the turn on time of transistor Q3 is delayed with respect to the turn on time of Q2 by the same angle. Thus, based on this circuit topology, the duty cycle of resonant tank voltage $V_T$=Va−Vb increases with decreasing angle $\phi$. Therefore, modulation of the phase angle $\phi$ results in pulse-width modulation (PWM) control of the voltage $V_T$.

Figure 4:
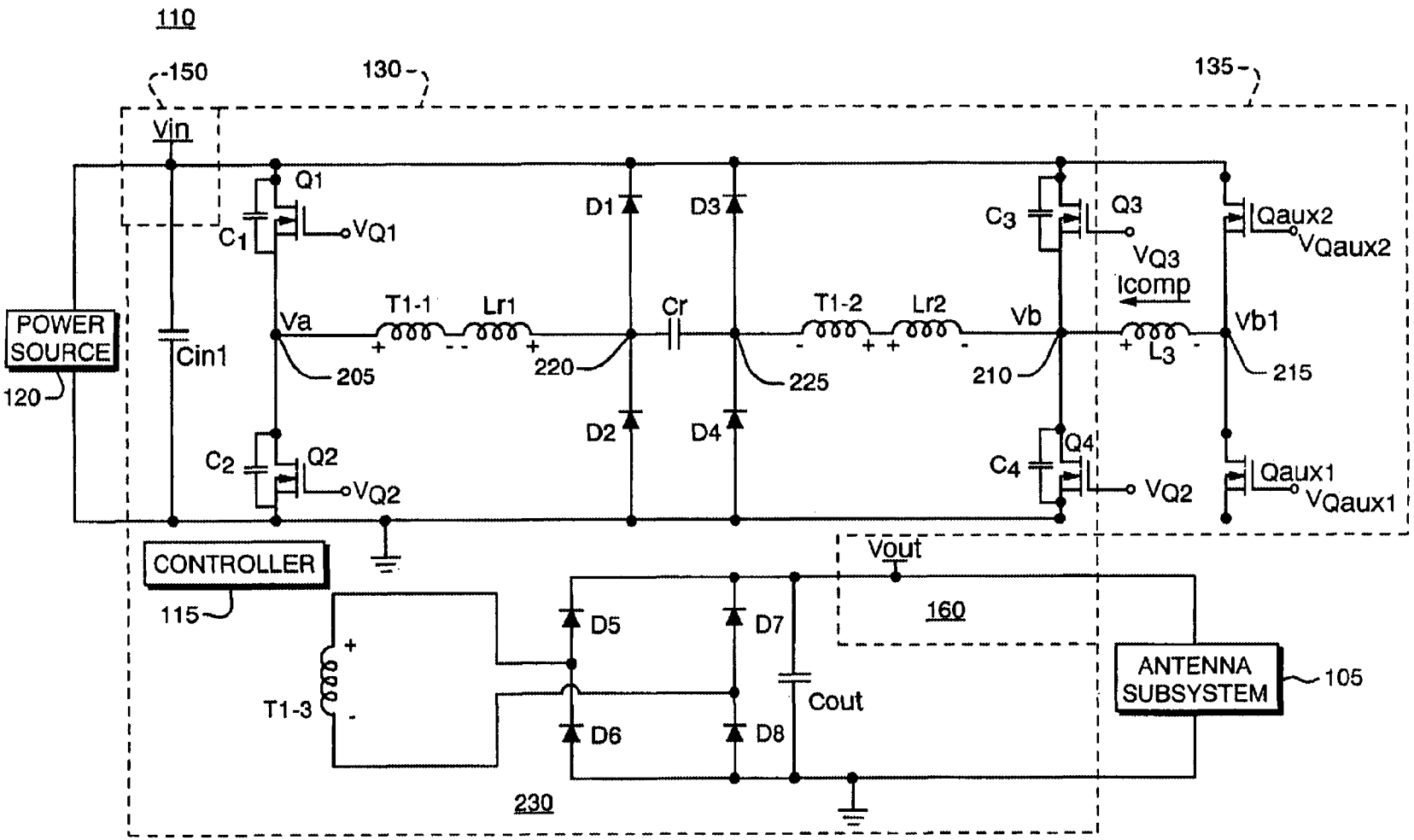
FIG. 4 is a schematic diagram of a power converter circuit.

The circuit configuration as shown in FIG. 1 includes a conventional snubber circuit L10 and can be used to produce ZVS while operating between a load range of approximately 25% to 100% of a maximum load condition. To maintain ZVS, the converter has a first interval of "dead time" (when both switches in either specified pair Q1/Q4 or Q2/Q3 are off). Examples of dead time are shown as DT1 and DT2 in FIG. 2. The dead time, $D_T$, for all transistors is set at the maximum value that equals one quarter of the oscillation period between the combined resonant inductance and total capacitance at the node $V_B$ (FIG. 4).

$D_T$ can be determined from the following equation:

$$D_T=\pi/2\sqrt{(L_{R1}+L_{R2})(C_{OSS}+C_{XF}+C_{EXT})} \quad (1)$$

where $C_{oss}$ is the non-linear output capacitance of power transistors Q1, Q2, Q3 and Q4; $C_{XF}$ is equivalent capacitance of the power transformer T1; $C_{EXT}$ is the value of external capacitors C1–C4 shown in FIG. 4; and $L_{R1}$, $L_{R2}$ are values of the resonant inductors.

For limited load values of greater than approximately 20% of maximum load and during a dead time when both transistors Q1/Q4 or Q2/Q3 are off, transient currents circulating through the circuit enable the power converter 190 to operate in a specified range. Generally, for a control angle of $\phi$ greater than zero, transistors Q1 and Q2 conduct additional circulating currents compared to Q3 and Q4. Thus, transistors Q1 and Q2 will operate with ZVS if transistors Q3 and Q4 operate with ZVS.

Transistors Q3 and Q4, however, need a minimum current in order to operate with ZVS. In terms of the required energy in the resonant inductors $L_{R1}$ and $L_{R2}$, this condition is expressed as follows:

$$\text{i } E_{L2}=\tfrac{1}{2}L_{R2}I_2^2\geqq\tfrac{4}{3}C_{OSS}V_{IN}^2+\tfrac{1}{2}C_{XF}V_{IN}^2+\tfrac{1}{2}C_{EXT}V_{IN}^2 \quad (2)$$

where $E_{L2}$ is the energy stored in the resonant inductor $L_{R2}$ at the beginning of the dead time interval and $I_2$ is the $L_{R2}$ current. Because the current $I_2$ and the energy $E_{L2}$ depend on the value of the load, the power converter circuit 190 optimized for the full load operation loses ZVS operation at lighter loads. The range of ZVS can be increased by increasing the angle between the resonant tank voltage and current $I_2$ at low line (deep lagging operation) or by reducing the self-resonant frequency of the resonant tank. However, these measures are counterproductive because they reduce converter efficiency in the middle of the load range and do not resolve the noise problem.

Figure 3:
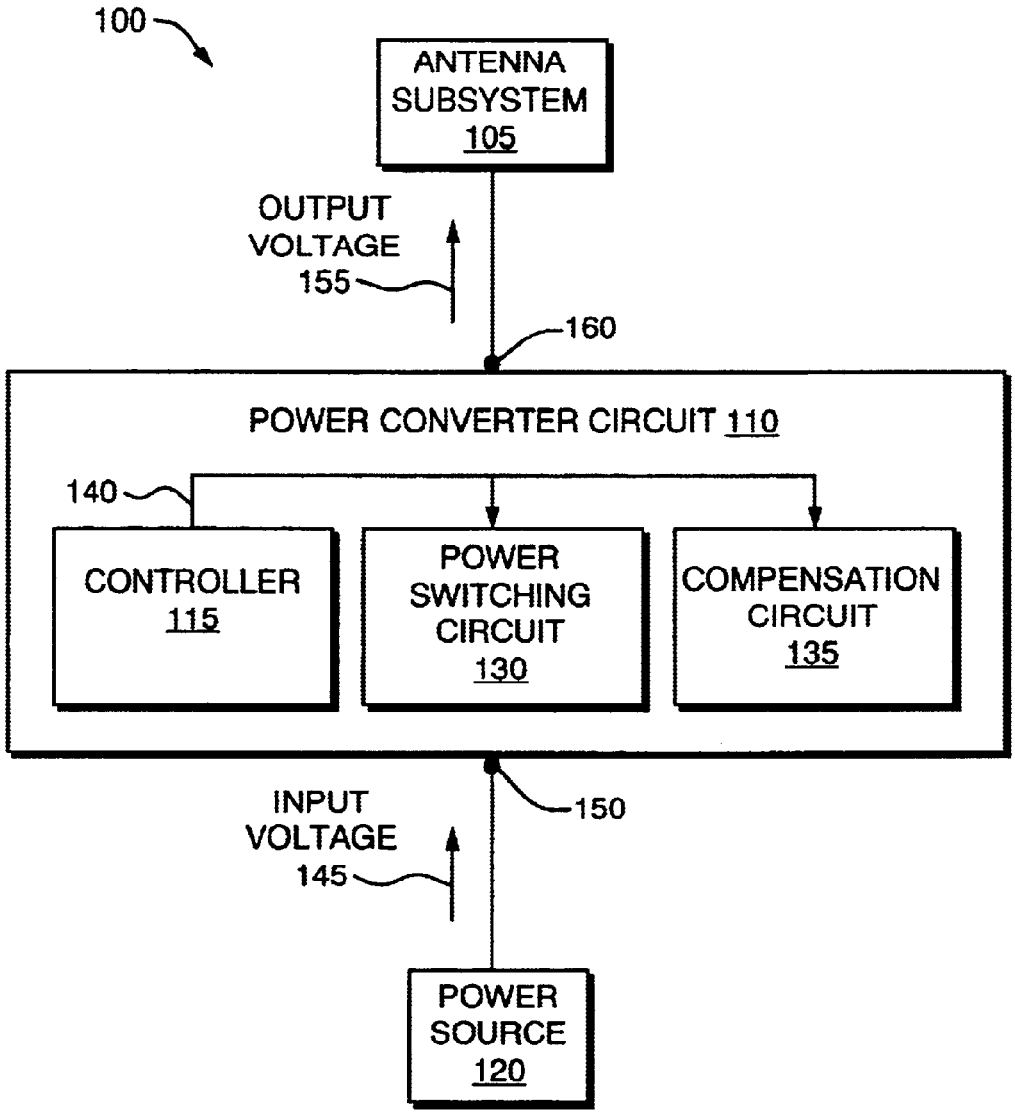
FIG. 3 is a block diagram of an antenna system including a power converter.

FIG. 3 is a block diagram of an antenna system according to certain principles of the present invention. As shown, the antenna system 100 includes an antenna subsystem 105, a power converter circuit 110, a controller 115 and a power source 120. The power converter circuit 110 is disposed between the antenna subsystem 105 and the power source 120.

Power converter circuit 110 includes an input terminal 150 for receiving power, an output terminal 160 for delivering power, a controller 115, and a power switching circuit 130 for converting an input voltage 145 to an output voltage 155. More specifically, the power converter circuit 110 receives an input voltage 145 from the power source 120 at input terminal 150. In response to the application of the input voltage 145 such as a DC voltage, output voltage 155 is produced at output terminal 160 based on a technique of switching internal transistors. In this way, power converter circuit 110 converts power supplied by power source 120 for use by antenna subsystem 105. Power source 120 produces the input voltage 145 supplied at Vin. In one application, power source 120 is a battery or other suitable input such as a power line input.

The power converter circuit 110 is generally a three-part circuit including controller 115, power switching circuit 130 and compensation circuit 135. The combination of these latter two circuits is used to regulate and produce the output voltage 155 within a specified range.

In one application, the antenna subsystem 105 is a phased-array radar antenna system. It can include a collection of many small radar antennas that are geometrically positioned to support beamforming. Depending on the application, the power consumed by such radar systems can substantially vary over time.

Although FIG. 1 illustrates converting power for antenna subsystem 105, power converter circuit 110 can be used to provide power for any suitable load that consumes power, even fixed loads.

Control signals 140 are produced by the controller 115 to control switching of transistors in converter 110. In general, the control signals 140 are time-varying signals that turn corresponding switches in power converter circuit 110 on and off at appropriate times.

As mentioned, the power converter circuit 110 performs the power conversion of input voltage 145 to output voltage 155. To improve performance, the power converter circuit 110 includes a compensation circuit 135 that generates a zero-voltage switching current or compensation current that helps reduce output noise. The amount of zero voltage switching current generated by the compensation circuit 135 depends on the output load, i.e., antenna subsystem 105, at a particular instance in time.

Accordingly, antenna subsystem 105 (output load) will sometimes consume much power while at other times it will consume very little power. Thus, the amount of zero-voltage switching current generated by compensation circuit 135 will vary over time.

FIG. 4 is a schematic diagram of a power converter circuit including a compensation circuit according to certain principles of the present invention. The power switching circuit 130 includes both passive and active circuit elements. In one arrangement, power converter circuit 130 includes components such as switching transistors, diodes, inductors, capacitors, and transformer devices as shown.

The power converter circuit 110 is configured as a DC/DC power converter. Typically, the power converter 110 receives an input voltage such as a 590 volt DC input and produces (based on internal switching) the output voltage 155 such as a 300 volt DC output at terminal 160. These voltages will vary depending on the application.

In the instance shown, power switching circuit 130 happens to be a clamped-mode series resonant DC/DC converter circuit. However, although power converter 130 is shown as a specific type of switching power supply circuit, it should be noted that the circuit configuration can vary depending on the application. For example, the circuit can be modified to produce an AC output voltage in lieu of a DC output voltage.

Transformer T1 includes three separate windings T1-1, T1-2, and T1-3 that share a common core, but are shown spread out in the drawing for simplicity. Transformer winding T1-1 is connected in series with inductor Lr1 between node 205 (Va) and node 220. Additionally, transformer winding T1-2 is connected in series with inductor Lr2 between node 225 and node 210 (Vb). The third winding of the transformer T1, namely, T1-3, is coupled to internal nodes of full-wave rectifier 230, which itself is connected to filter capacitor $C_{out}$.

Generally, during converter operation, transistors in power converter circuit 130 are switched to alternate a voltage polarity applied to transformer windings T1-1 and T1-2. For example, during at least part of a switching cycle while Q2 and Q3 are off, Q1 and Q4 are simultaneously switched on so that current flows through the series of components (transformer winding T1-1, inductor Lr1, capacitor Cr, transformer winding T1-2, and inductor Lr2) between node 205 and node 210. During another part of the switching cycle, current flows through components between node 205 and node 210, but in an opposite direction as just discussed.

Based on this general routine of switching main power transistors Q1, Q2, Q3, and Q4 (by control signals 140), energy is transferred from primary windings T1-1 and T1-2 of transformer T1 to output winding T1-3. The voltage produced across transformer winding T1-3 is rectified via diodes D5, D6, D7, and D8 to produce the DC output voltage 155 (Vout) for powering antenna subsystem 105.

Compensation circuit 135 includes a combination of controllable switching devices, namely, switching transistors Qaux2 and Qaux1. These transistors are configured so that inductor L3 is coupled to a reference voltage (i.e., ground or Vin) in an alternating manner based on switching of transistors Qaux1 and Qaux2. More specifically, node at Vb1 of inductor Lr3 is connected to Vin when transistor Qaux2 is on and transistor Qaux1 is off. Conversely, the node Vb1 is connected to ground when Qaux1 is turned on and transistor Qaux2 is off.

It should be noted that although input voltage 145 and output voltage 155 both are referenced to a common ground, the referencing of internal and external circuit voltages can vary depending on the application.

During switching operation, compensation circuit 135 and, more specifically, inductor L3 generates a (compensation current) zero voltage switching current. The injection of this zero voltage switching current into power converter switching circuit 130 at node 210 (Vb) helps to ensure that the output voltage noise is reduced. Without the compensation circuit 135, power converter circuit 130 may otherwise produce unwanted noise, ripple and voltage spikes on output voltage 155.

The zero-voltage switching current Icomp generated by compensation circuit 135 increases as a result of a decreasing load. For example, compensation circuit 135 produces less ZVS current (compensation current) for lighter lights such as less than 25% of maximum load and more current at heavier loads.

The power switching transistors Q1, Q2, Q3, and Q4, and auxiliary switches Qaux1, and Qaux2 are shown as field effect transistors. However, any suitable type of alternative switching device can be used in their place.

For higher power applications, power transistors Q1, Q2, Q3, and Q4 are high power switching devices capable of switching many amperes of current. Transistors Qaux1 and Qaux2 typically are smaller in size than transistors Q1, Q2, Q3 and Q4. the smaller sized transistors can be used because the zero-voltage switching current Icomp generated by inductor L3 is usually smaller than the current that is switched through transistors Q1, Q2, Q3, and Q4.

Capacitors such as C1, C2, C3 and C4 are optionally disposed in parallel (i.e., the capacitors are connected across source and drain output terminals of the transistors) to respective power transistors Q1, Q2, Q3, and Q4. When used, the capacitors help reduce "turn off" power dissipation. Additionally, the capacitors help reduce noise generated during the "turn off" switching interval by slowing down the rate of the increasing voltage produced across the corresponding transistor.

In a specific application, power converter circuit 110 operates at a frequency of 200 kHz (kilohertz) and inductors Lr1 and Lr2 are 16 $\mu$H (microhenries). Power conversion capacitor Cr is for example 33 nF (nanofarads). Transformer T1 can include 3 separate windings, each having a unique number of turns. In the instance shown, transformer windings T1-1 and T1-2 are 12 turns each, while winding T1-3 is 21 turns. Although specific component values have been identified for illustrative purposes, it should be noted that values of the aforementioned components can vary depending on the application.

Figure 5:
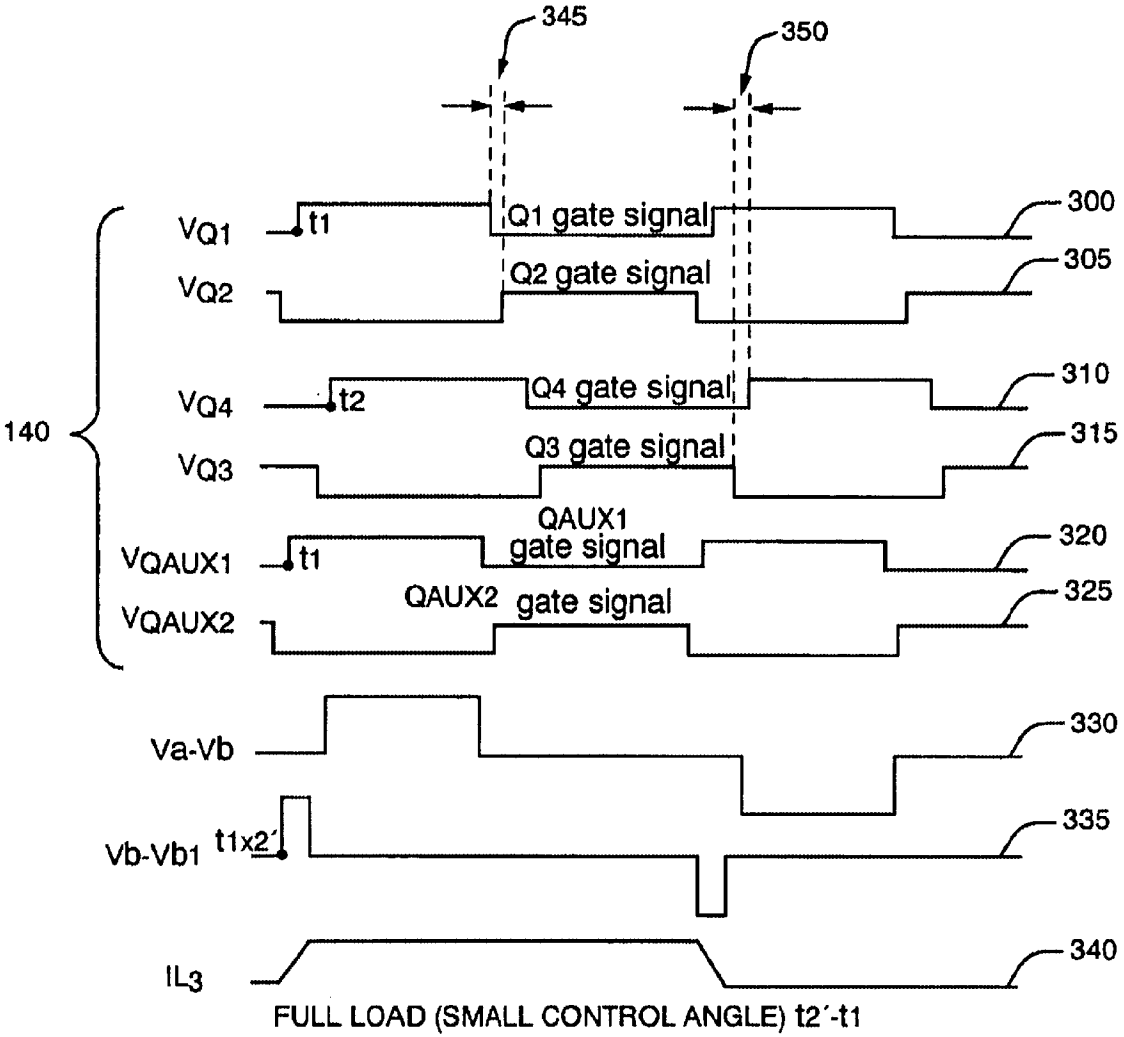
FIG. 5 is a timing diagram of input control signals and output waveforms associated with the power converter shown in FIG. 4 at full load.

FIG. 5 is a timing diagram illustrating transistor drive waveforms and resulting voltage and current waveforms at full load condition of the DC/DC converter in FIG. 4.

As shown in FIG. 5, time-varying control signals 140, namely, Vq1 (waveform 300), Vq2 (waveform 305), Vq3 (waveform 315), Vq4 (waveform 310), Vqaux1 (waveform 320), and Vqaux2 (waveform 325) respectively drive corresponding gate inputs of transistor switches Q1, Q2, Q3, Q4, Qaux1, and Qaux2. Waveform 330 illustrates the tank voltage difference between node 205 and node 210 (Va−Vb). Waveform 335 illustrates the voltage across inductor L3 (Vb−Vb1). Finally, waveform 340 illustrates the snubber current through inductor L3 at full load conditions.

The input waveforms illustrate the voltage level applied to corresponding gates over time. For example, voltage Vq1 is the time-varying voltage applied to transistor Q1 that causes it to turn on and off. At time t1, transistor Q1 turns on because a high voltage (such as +10 volts) is applied to the gate. When a low voltage (such as zero volts) is applied to the gate of transistor Q1, the switch turns off (see time just prior to t1). The voltage levels of the time-varying signals may vary depending on the type of switch that it drives.

It should be noted that gate control signals 140 driving gates of transistors Q1 and Q2 are also used to respectfully drive Qaux1 and Qaux2. More specifically, the control signal 140 (waveform 300) driving transistor Q1 is the same as control signal 140 (waveform 320 ) driving transistor Qaux1. Likewise, the control signal 140 (waveform 305) driving transistor Q2 is the same as control signal 140 (waveform 325) driving transistor Qaux2. Although not necessary, this reuse of already existing signals to drive transistor Qaux1 and transistor Qaux2 reduces the complexity of controller 115 that would otherwise have to generate an additional set of very specific time-varying control signals.

Figure 2:
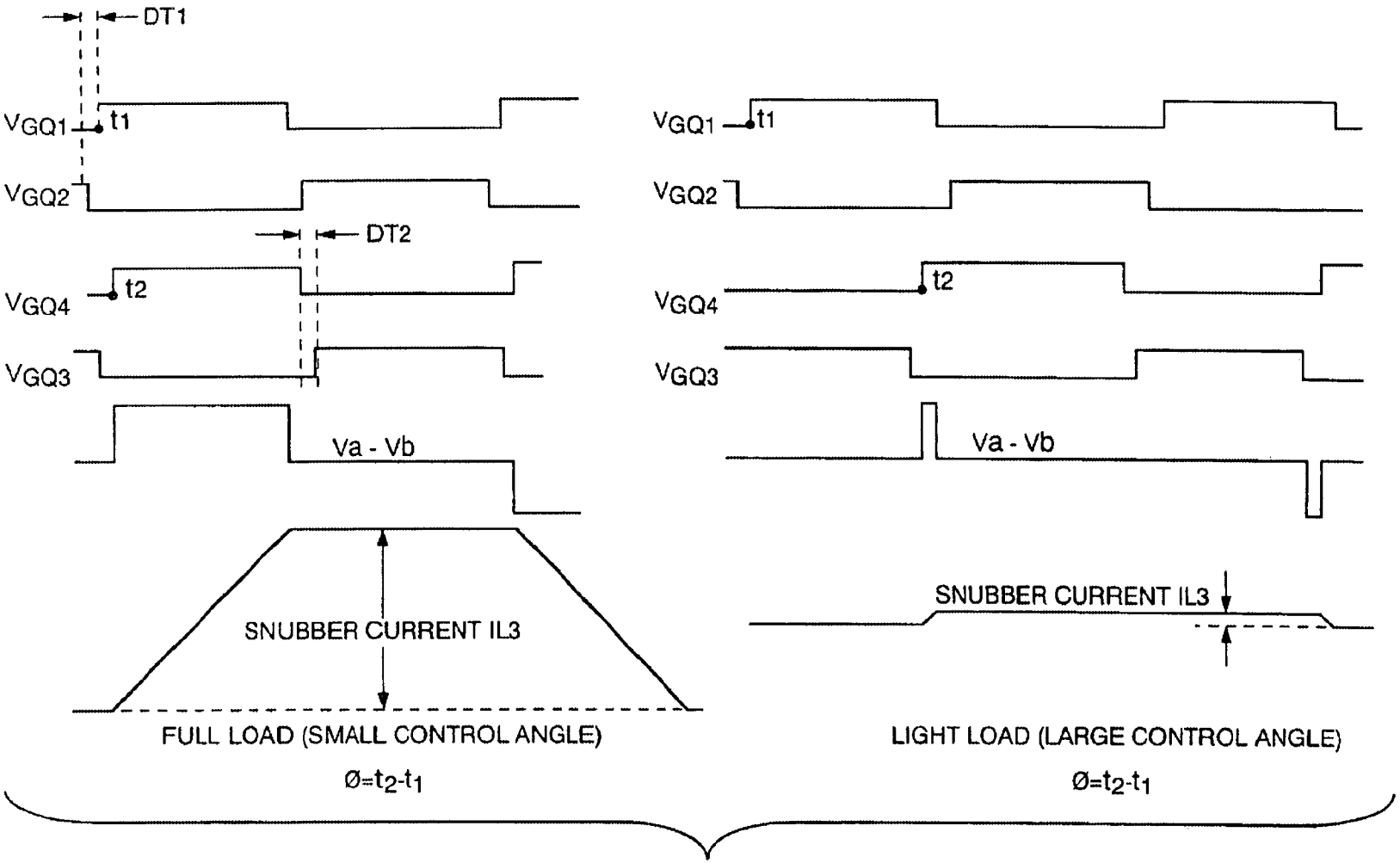
FIG. 2 PRIOR ART
FIG. 2 is a control signal timing diagram and output waveform associated with the schematic in FIG. 1.

As previously discussed, compensation circuit 135 generates smaller zero-voltage switching current Icomps (compensation current) at heavy loads. For example, note that the zero voltage switching current in waveform 340 is relatively small compared to the snubber current produced at full load conditions as shown in FIG. 2.

Also as discussed, increasing the zero voltage switching current at low loads according to the principles of the present invention results in higher efficiency at light load conditions and a cleaner output signal. In such an instance, the compensation circuit 135 provides snubber current to transistors Q3 and Q4 to maintain ZVS operation in the converter circuit 130 at low load.

At full converter output loads, the voltage differential Vb−Vb1 across inductor L3 (in FIG. 4) is small, and thus the inductor L3 injects little zero-voltage switching current Icomp at node 210 as shown in waveform 340. At lighter output loads, the voltage differential Vb−Vb1 across inductor L3 is large, and thus the inductor L3 injects more zero-voltage switching current Icomp at node 210. In this way, the compensation circuit 135 automatically adjusts zero-voltage switching current Icomp in response to load deviations. Consequently, the power converter circuit 110 is capable of responding quickly to changes in load values and line voltage (input voltage 145).

Although better regulation of the ZVS current is achieved using inherently stable feed-forward control techniques in which gate signals for Qaux1 and Qaux2 are identical to those for Q1 and Q2, it should be noted that a closed loop feedback circuit or other suitable circuit topology can be used to achieve similar desirable results.

Figure 6:
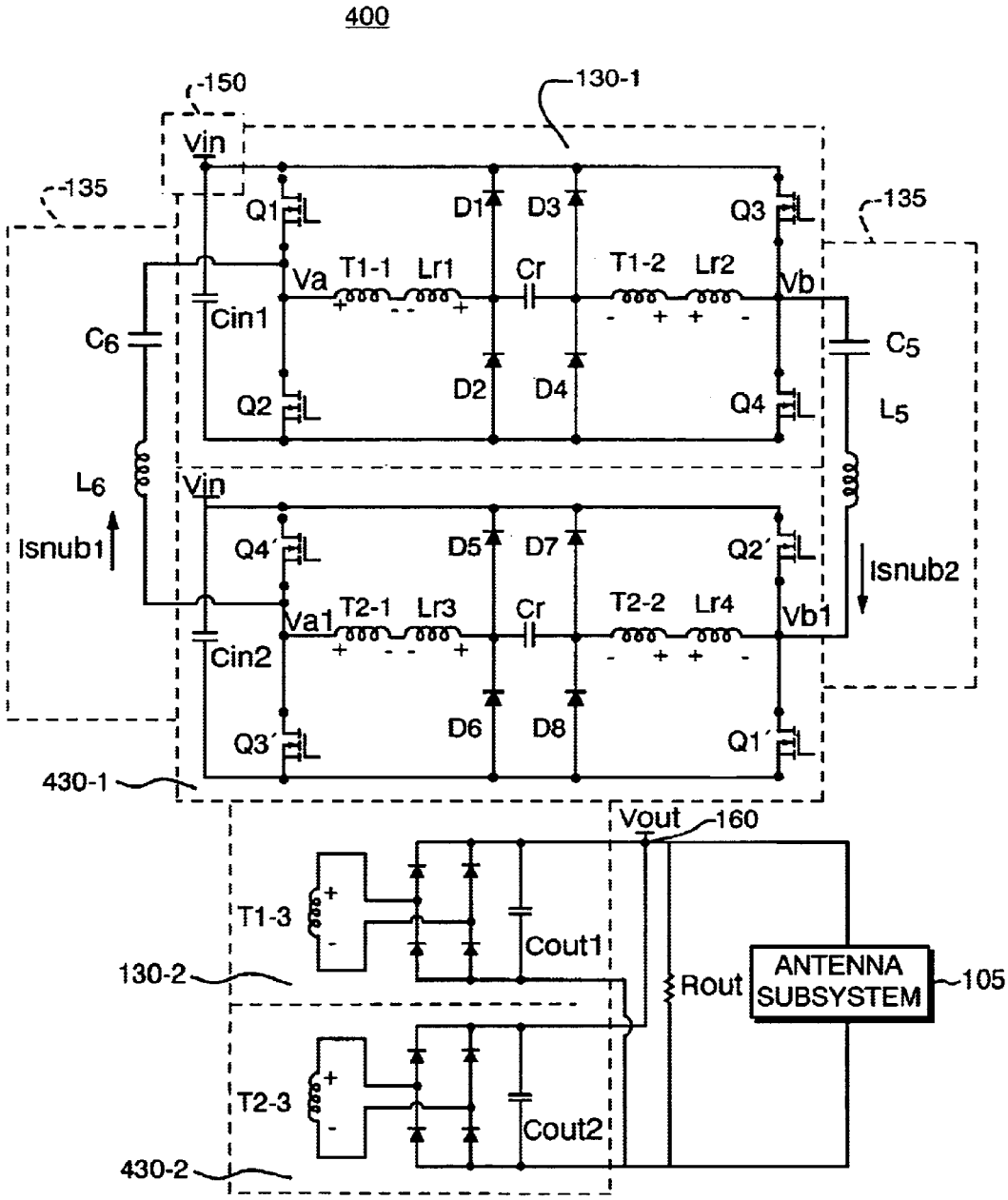
FIG. 6 is a schematic of a dual power converter circuit.

FIG. 6 is a schematic diagram of another power converter circuit for converting power according to certain principles of the present invention.

As shown, power converter circuit 400 includes dual clamped-mode series resonant converter circuits 130, 430 including a compensation circuit 135 according to principles of the present invention. Certain operation of the dual converter circuits is similar to that described for FIG. 3. For example, input voltage 145 is converted to output voltage 155 using time-varying switching control signals 140 that cause internal power switching transistors to turn on and off at the appropriate time. However, in the circuit 400 shown in FIG. 6, the clamped mode series converters 130, 430 operate in parallel to produce a common output voltage 155 that is used to power a load. This combination of converter circuits 130, 430 can be used to increase an amount of power delivered to a load.

Generally, the two converter circuits 130, 430 are "parallel-coupled" via passive elements such as inductor L5 and L6. These components provide connections between converter circuits 130, 430 that generate compensation currents. The compensation currents are automatically generated by the inductors, which ensure that the dual converter circuit 400 produces a cleaner output voltage 155 to drive, for example, antenna subsystem 105.

Capacitors C5 and C6 are optionally disposed in series with respective inductors L5 and L6. When used, capacitors C5 and C6 act as blocking elements that eliminate a DC component from compensating currents Isnub1 and Isnub2.

Additional capacitors can be disposed in parallel with corresponding switching power transistors similar to those shown and discussed in FIG. 3.

A benefit of coupling two or more converter circuits 130, 430 as shown in FIG. 6 is reduced circuit costs. For example, identical power converter circuits (and therefore lower cost circuits) can be coupled using passive electronic components to produce a higher output power. The passive electronic components (such as L5 and L6) do not need to be driven by control signals and there is no need to provide extra transistor control signals to drive auxiliary transistors.

The dual converter circuit 400 can operate with ZVS over the full range between substantially 100% load (full load) to substantially 0% load (no load). Both converter circuit 130 (shown as two parts, namely, circuit 130-1 and circuit 130-2), and converter circuit 430 (shown as two parts, namely, circuit 430-1 and circuit 430-2), are controlled using similar control signals 140. However, because the second converter circuit 430 is configured as an inverted mirror image of the first converter circuit 130, the control of the second DC/DC converter circuit 430 uses inverted and anti-phase control signals compared to those used in the first converter circuit 130. Specific timing of control signals is shown in the following two figures (FIGS. 7 and 8).

During operation, each pair of legs of converter circuit 130, 430 generates a separate snubber current. For example, the first leg (transistors Q4' and Q3') of the second converter circuit 430 and the first leg (transistors Q1 and Q2) of the first converter circuit 130 generate snubber current Isnub1. The second leg (transistor Q3 and Q4) of the first converter circuit 130 and the second leg (transistors Q2' and Q1') of the second converter circuit 430, in turn, generate snubber current Isnub2. Similar to generating the zero-voltage switching current as previously discussed, the snubber currents Isnub1 and Isnub2 are relatively small for heavy loads and larger for smaller loads to maintain high efficiency and low noise at light loads.

Figure 7:
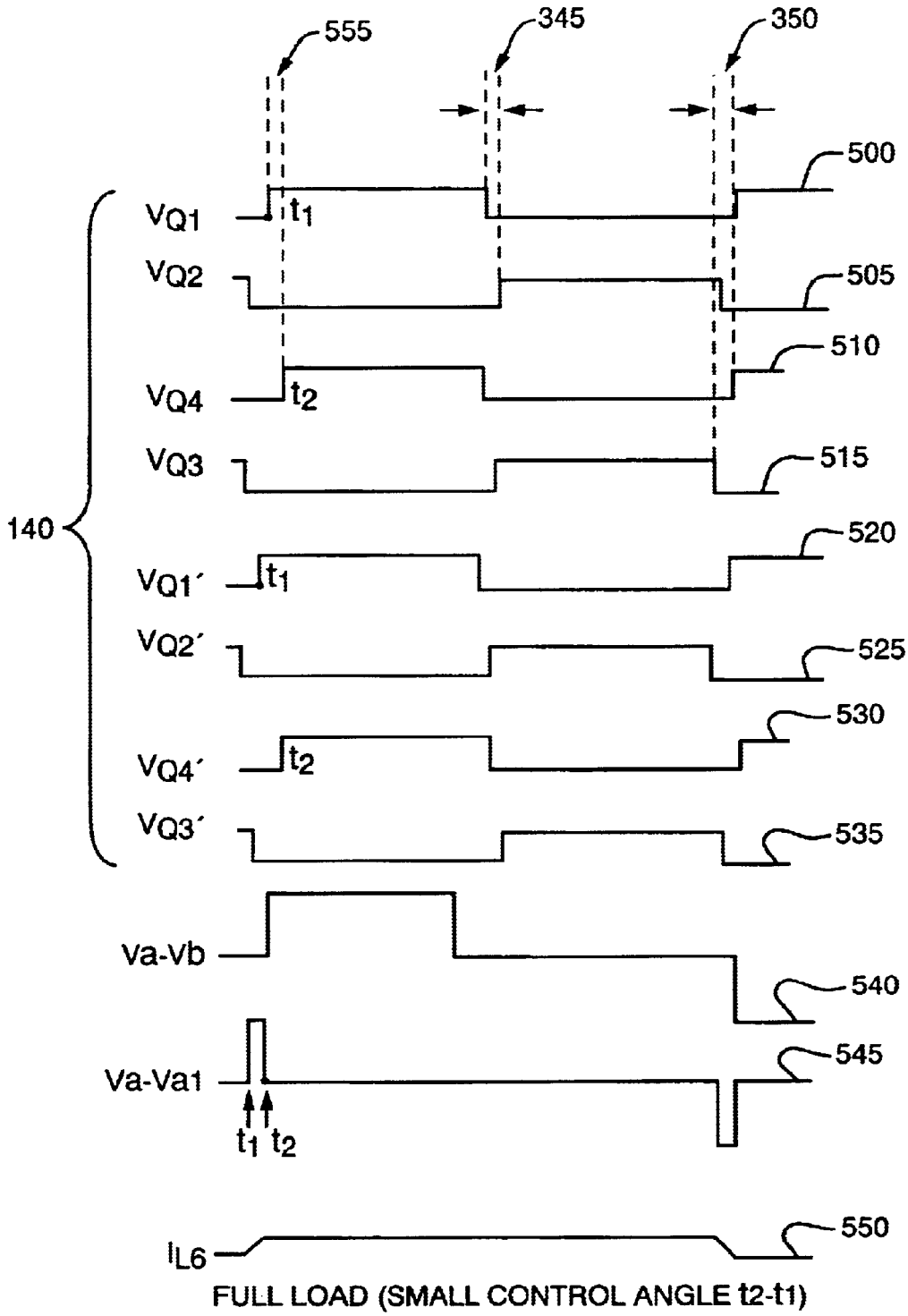
FIG. 7 is a timing diagram of input control signals and output waveforms associated with the dual power converter shown in FIG. 6 at full load.
Figure 8:
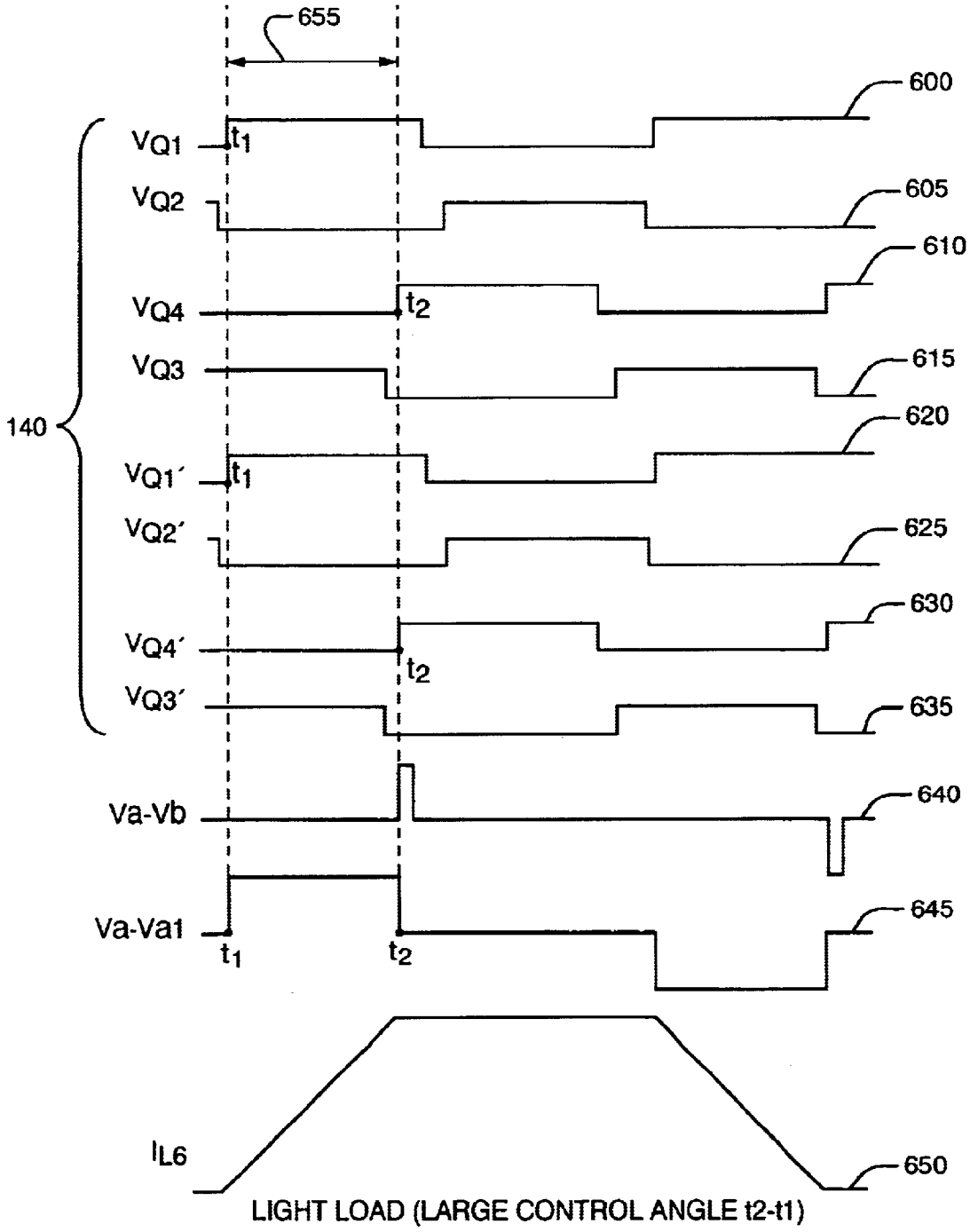
FIG. 8 is a timing diagram of input control signals and output waveforms associated with the dual power converter shown in FIG. 6 at light load.

FIG. 7 is a timing diagram of transistor gate input waveforms and output voltage and current waveforms at full load in the dual power converter circuit of FIG. 6.

The input voltages Vq1, Vq2, Vq3, Vq4, Vq1', Vq2', Vq3', and Vq4' respectively drive gates of corresponding transistors Q1, Q2, Q3, Q4, Q1', Q2', Q3', and Q4' to turn them on and off at the appropriate times. A high voltage indicates when the transistor switch is turned on and a low voltage indicates when the transistor switch is turned off.

The output waveforms (540, 545, and 550) illustrate internal voltages and currents of the dual power converter circuit 400 during full load conditions. The tank voltage of the converter circuit 130 is shown in waveform 540 (Va−Vb), which is the voltage differential across the following series-connected elements: transformer windings T1-1, T1-2, resonant inductors Lr1 and Lr2, and capacitor Cr (between terminals 205 and 210). Additionally, the voltage across inductor L6 (compensation circuit 135) is shown in waveform 545 (Va−Va1). The compensation current IL6 or Isnub1 (waveform 550) indicates that a relatively small compensation current is produced by power converter circuits 130 and 430 at full load conditions to maintain their ZVS operation.

FIG. 8 is a timing diagram of transistor gate input waveforms and output voltage and current waveforms at light load for the dual power converter circuit of FIG. 6.

Similar to that shown for the previous figure, the input time-varying voltage waveforms Vq1, Vq2, Vq3, Vq4, Vq1', Vq2', Vq3', and Vq4' respectively drive gates of corresponding transistors Q1, Q2, Q3, Q4, Q1', Q2', Q3', and Q4' to turn them on and off at the appropriate times. A high voltage indicates when the transistor switch is turned on and a low voltage indicates when the transistor switch is turned off.

The waveforms (640, 645, and 650) illustrate internal voltages and currents of the dual power converter circuit 400 (in FIG. 6) during light load conditions. The tank voltage of the converter circuit 130 is shown in waveform 640 (Va−Vb), which is the voltage differential across the following series-connected elements: transformer windings T1-1, T1-2, resonant inductors Lr1 and Lr2, and capacitor Cr (between terminals 205 and 210). Additionally, the voltage across inductor L6 (compensation circuit 135) is shown in waveform 645 (Va−Va1). The compensation current IL6 or Isnub1 (waveform 650) indicates that a relatively large compensation current is produced by power converter circuit 430 at light load conditions to maintain the low output noise and high efficiency at light loads.

The generation of different levels of compensation current IL6 or Isnub1 can be best understood based on a comparison of the waveforms in FIGS. 7 and 8. Such a comparison reveals that the control angle ϕ changes depending on load conditions. For example, the control angle ϕ at light load conditions indicated by time difference 655 (ϕ=t2-t1) in FIG. 8 is larger than the control angle ϕ at full load conditions as indicated by time difference 555 (t2-t1) in FIG. 7. This larger control angle results in a longer non-zero differential voltage across inductor L6. Thus, the overall snubber current Isnub1 is greater at lighter loads and relatively smaller at heavier loads.

During operation and at lighter loads as shown in FIG. 8, transistors Q1 and Q2 are alternately switched based on an approximate 50% duty cycle, and transistors Q3 and Q4 are alternately switched based on an approximate 50% duty cycle. Transistor Q1 is the leading transistor while transistor Q2 is delayed by approximately 180 degrees with respect to transistor Q1. The control signal for transistor Q4 lags behind that of transistor Q1 by the angle ϕ while the control signal for transistor Q3 is delayed approximately 180 degrees with respect to the signal to transistor Q4.

Transistors Q1', Q2,' Q3' and Q4' are driven with mirror image gate signals as that just described for transistors Q1, Q2, Q3, and Q4 and include an appropriate 180 degrees phase difference. This results in an anti-phase connection between power converter 130 and power converter 430.

As discussed, the controller 115 controls the first converter circuit 130 by delaying the turn-on of transistor Q4 with respect to transistor Q1 by angle ϕ and by delaying turn-on of transistor Q3 with respect to transistor Q2 also by angle ϕ. The tank voltage duty cycle increases with decreasing angle ϕ as illustrated by waveform 540 in FIG. 7 and waveform 640 in FIG. 8. At higher output loads, the voltage across inductor L6 (Va−Va1, waveform 545 in FIG. 7) is small and consequently the current Isnub1 is relatively small as shown in waveform 550 of FIG. 7. At low output load conditions, the voltage across inductor L6 (Va−Va1, waveform 645 of FIG. 8) is large, and consequently Isnub1 is relatively large as shown in waveform 650. Accordingly, at low loads when the converter circuits 130 and 430 need increased zero-voltage switching current to operate efficiently, Isnub1 is increased. The converter circuits operate similarly to provide snubber current Isnub2.

A desirable feature of the dual power converter circuit 400 is increased efficiency. For example, the dual power converter circuit 400 shown in FIG. 6 maintains a higher ZVS current all the way to approximately 0% load, and thus provides better efficiency even at lighter loads. Such higher efficiency translates into lower power dissipation by the dual converter circuit 400 itself. Consequently, more power can be provided by power source 120 to power a load. The lower power dissipation in power converter circuit 400 improves its reliability because internal components are less stressed as a result of reduction of internal heat.

Figure 9:
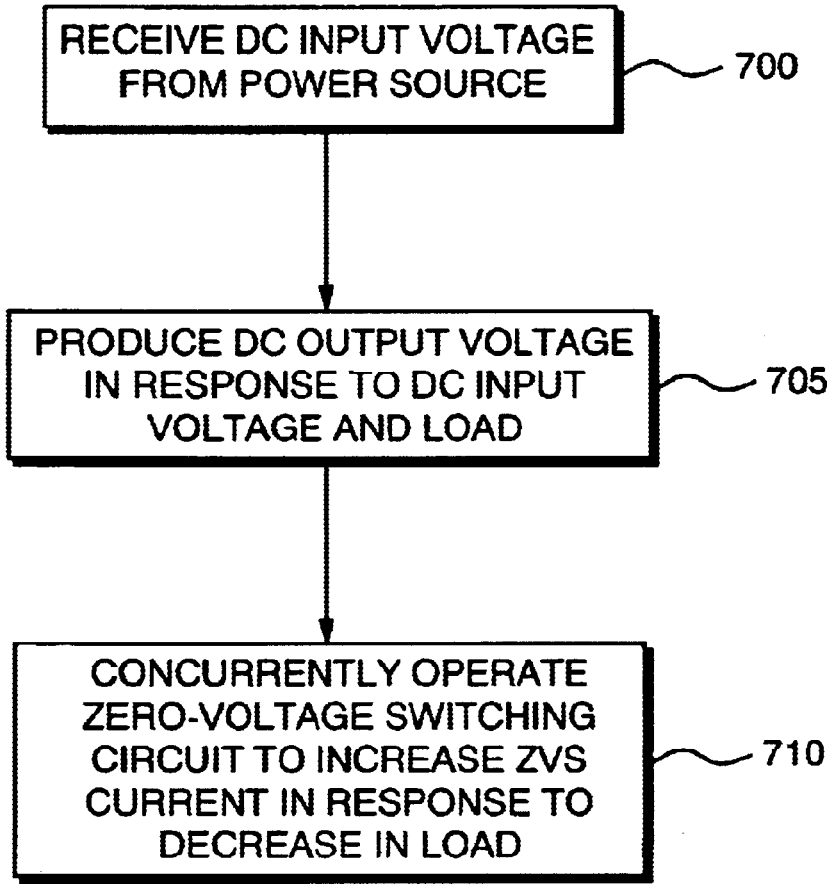
FIG. 9 is a flow chart illustrating the operation of a power converter device.

FIG. 9 is a flow chart illustrating general operation of the power converter devices as previously discussed.

In step 700, the power converter 110 receives input voltage 145 from the power source 120.

In step 705, the power converter 110 converts the input voltage 145 to output voltage 155 in response to receiving the DC input voltage 145. In order to regulate the DC output voltage 155 within a desired range, the controller 115 generates time-varying control signals 140. The control signals 140 are used to open and close main power switching transistors in the power converter circuit 110.

The power converter circuit 110 includes a set of main power switches, namely, transistors Q1, Q2, Q3 and Q4. Two of the transistors (transistors Q1 and Q2) are primary (leading) transistors and two of the transistors (transistors Q3 and Q4) are lagging. During operation, the controller 115 controls the power converter circuit 110 by delaying the turn-on of lagging transistors Q3 and Q4 with respect to the primary transistors Q1 and Q2.

In step 710, the compensation circuit 135 and converter circuits 130 and 430 operate concurrently to provide a clean output voltage 155. Reduced noise and higher efficiency at light loads are achieved at least in part as a result of automatically increasing zero-voltage switching current (Icomp) of the power converter circuit 110 in response to a decrease in the load. In one embodiment, control signals 140 generated by controller 115 are used to switch auxiliary switches Qaux1 and Qaux2 that, in turn, generate the zero-volt switching current (Icomp). In another embodiment including dual power converters, the power converter circuits 130, 430 provide zero voltage switching current (Icomp) to each other.

It should be understood that the above-described embodiments are simply illustrative of the principles of the invention. Various and other modifications and changes may be made by those skilled in the art which will embody the principles of the invention and fall within the spirit and scope thereof.

What is claimed is:

1. A method for providing power to a load, the method comprising:

receiving, at a power converter, power from a power source;

supplying, from the power converter, an output voltage to the load in response to receiving the power from the power source; and while the output voltage is supplied to the load, adjusting a zero-voltage switching current within the power converter in a direction that is opposite a change in the load to increase the zero-voltage switching current within the power converter in response to a decrease in the load, and decrease the zero-voltage switching current within the power converter in response to an increase in the load.

2. The method of claim 1, wherein adjusting the zero-voltage switching current includes:

raising the zero-voltage switching current of the power converter while the power converter concurrently provides, as the output voltage, a substantially clean direct current voltage signal when the load drops to less than approximately twenty percent of a maximum potential load value.

3. The method of claim 1, wherein the power converter includes a set of main switches and a set of auxiliary switches, wherein the set of main switches operates in response to a set of control signals to supply the output voltage to the load, and wherein adjusting the zero-voltage switching current includes:

operating the set of auxiliary switches in response to the set of control signals to adjust the zero-voltage switching current.

4. The method of claim 3, wherein the set of control signals includes a first control signal and a second control signal that is substantially out of phase with the first control signal, wherein the set of auxiliary switches includes a first auxiliary switch and a second auxiliary switch, and wherein operating the set of auxiliary switches includes:

providing the first control signal to the first auxiliary switch, and concurrently providing the second control signal that is substantially out of phase with the first control signal to the second auxiliary switch, to adjust the zero-voltage switching current.

5. The method of claim 1, wherein the power converter includes a first clamped-mode series resonant converter circuit and a second clamped-mode series resonant converter circuit that mirrors the first clamped-mode series resonant converter circuit, and wherein adjusting the zero-voltage switching current includes:

simultaneously operating the first clamped-mode series resonant converter circuit and the second clamped-mode series resonant converter circuit in substantially opposite phases with each other.

6. The method of claim 1, wherein the power converter includes a clamped-mode series resonant converter circuit and a zero-voltage switching circuit; wherein the zero-voltage switching circuit includes an inductor, a first auxiliary switch interconnected between the inductor and a voltage reference, and a second auxiliary switch interconnected between the inductor and a ground reference; and wherein adjusting the zero-voltage switching current includes:

opening and closing the first auxiliary switch and the second auxiliary switch to form the zero-voltage switching current from the inductor.

7. The method of claim 6, wherein the clamped-mode series resonant converter circuit includes a set of main power transistors, wherein the first auxiliary switch is a first auxiliary transistor having a smaller die size than that of each main power transistor, wherein the second auxiliary switch is a second auxiliary transistor having a smaller die size than that of each main power transistor, and wherein opening and closing the first auxiliary switch and the second auxiliary switch includes:

operating the first and second auxiliary transistors to form the zero-voltage switching.

8. A converter, comprising:

a set of power source terminals which is configured to connect to a power source;

a set of load terminals which is configured to connect to a load; and operating circuitry interconnected between the set of power source terminals and the set of load terminals; the operating circuitry, when the power source connects to the set of power source terminals and when the load connects to the set of load terminals, being configured to:

receive power from the power source, supply an output voltage to the load in response to receiving the power from the power source, and while the output voltage is supplied to the load, adjust a zero-voltage switching current within the operating circuitry in a direction that is opposite a change in the load to increase the zero-voltage switching current within the operating circuitry in response to a decrease in the load, and decrease the zero-voltage switching current within the operating circuitry in response to an increase in the load.

9. The converter of claim 8, wherein the operating circuitry, when adjusting the zero-voltage switching current, is configured to:

raise the zero-voltage switching current within the operating circuitry while the operating circuitry concurrently provides, as the output voltage, a substantially clean direct current voltage signal when the load drops to less than approximately twenty percent of a maximum potential load value.

10. The converter of claim 8, wherein the operating circuitry includes a set of main switches and a set of auxiliary switches, wherein the set of main switches is configured to operate in response to a set of control signals to supply the output voltage to the load, and wherein the set of auxiliary switches is configured to operate in response to the set of control signals to adjust the zero-voltage switching current.

11. The converter of claim 10, wherein the set of control signals includes a first control signal and a second control signal that is substantially out of phase with the first control signal, wherein the set of auxiliary switches includes a first auxiliary switch and a second auxiliary switch, wherein the first auxiliary switch is configured to operate in response to the first control signal, and wherein the second auxiliary switch is configured to operate in response to the second control signal that is substantially out of phase with the first control signal.

12. The converter of claim 8, wherein the operating circuitry includes a first clamped-mode series resonant converter circuit and a second clamped-mode series resonant converter circuit that mirrors the first clamped-mode series resonant converter circuit, and wherein the first clamped-mode series resonant converter circuit and the second clamped-mode series resonant converter circuit are configured to operate in substantially opposite phases with each other.

13. The converter of claim 8, wherein the operating circuitry includes a clamped-mode series resonant converter circuit and a zero-voltage switching circuit; wherein the zero-voltage switching circuit includes an inductor, a first auxiliary switch interconnected between the inductor and a voltage reference, and a second auxiliary switch interconnected between the inductor and a ground reference; and wherein the first auxiliary switch and the second auxiliary switch are configured to open and close to form the zero-voltage switching current from the inductor.

14. The converter of claim 13, wherein the clamped-mode series resonant converter circuit includes a set of main power transistors, wherein the first auxiliary switch is a first auxiliary transistor having a smaller die size than that of each main power transistor, and wherein the second auxiliary switch is a second auxiliary transistor having a smaller die size than that of each main power transistor.

15. A radar system, comprising:

an antenna subsystem;

a converter controller which is configured to provide a set of control signals; and a converter coupled to the antenna subsystem and the converter controller, the converter being configured to provide power to the antenna subsystem in response to the set of control signals, the converter including:

a set of power source terminals which is configured to connect to a power source, a set of load terminals which connects to the antenna subsystem, and operating circuitry interconnected between the set of power source terminals and the set of load terminals; the operating circuitry, when the power source connects to the set of power source terminals, being configured to:

receive power from the power source, supply an output voltage to the antenna subsystem in response to receiving the power from the power source, and while the output voltage is supplied to the antenna subsystem, adjust a zero-voltage switching current within the operating circuitry in a direction that is opposite a change in a load of the antenna subsystem to increase the zero-voltage switching current within the operating circuitry in response to a decrease in the load of the antenna subsystem, and decrease the zero-voltage switching current within the operating circuitry in response to an increase in the load of the antenna subsystem.

16. The radar system of claim 15, wherein the operating circuitry of the converter, when adjusting the zero-voltage switching current, is configured to:

raise the zero-voltage switching current within the operating circuitry while the operating circuitry concurrently provides, as the output voltage, a substantially clean direct current voltage signal when the load drops to less than approximately twenty percent of a maximum potential load value of the antenna subsystem.

17. The radar system of claim 15, wherein the operating circuitry of the converter includes a set of main switches and a set of auxiliary switches, wherein the set of main switches is configured to operate in response to the set of control signals to supply the output voltage to the load, and wherein the set of auxiliary switches is configured to operate in response to the set of control signals to adjust the zero-voltage switching current.

18. The radar system of claim 17, wherein the set of control signals includes a first control signal and a second control signal that is substantially out of phase with the first control signal, wherein the set of auxiliary switches includes a first auxiliary switch and a second auxiliary switch, wherein the first auxiliary switch is configured to operate in response to the first control signal, and wherein the second auxiliary switch is configured to operate in response to the second control signal that is substantially out of phase with the first control signal.

19. The radar system of claim 15, wherein the operating circuitry of the converter includes a first clamped-mode series resonant converter circuit and a second clamped-mode series resonant converter circuit that mirrors the first clamped-mode series resonant converter circuit, and wherein the first clamped-mode series resonant converter circuit and the second clamped-mode series resonant converter circuit are configured to operate in substantially opposite phases with each other.

20. The radar system of claim 15, wherein the operating circuitry of the converter includes a clamped-mode series resonant converter circuit and a zero-voltage switching circuit; wherein the zero-voltage switching circuit includes an inductor, a first auxiliary switch interconnected between the inductor and a voltage reference, and a second auxiliary switch interconnected between the inductor and a ground reference; and wherein the first auxiliary switch and the second auxiliary switch are configured to open and close to form the zero-voltage switching current from the inductor.

21. The radar system of claim 20, wherein the clamped-mode series resonant converter circuit includes a set of main power transistors, wherein the first auxiliary switch is a first auxiliary transistor having a smaller die size than that of each main power transistor, and wherein the second auxiliary switch is a second auxiliary transistor having a smaller die size than that of each main power transistor.

22. A method for converting power, the method comprising:

providing a converter that receives power from a power source;

in response to receiving the power at the converter, generating an output voltage from the converter to power a load; and including a compensation circuit in the converter to reduce output voltage noise of the converter, the compensation circuit generating less zero-voltage switching current in the converter at higher load to increase its efficiency.

23. A method as in claim 22, wherein adjusting the zero-voltage switching current of the converter includes:

increasing a zero-voltage switching current of the converter in response to a reduced load condition.

24. A method as in claim 22, wherein adjusting the zero-voltage switching current of the converter includes:

increasing a zero-voltage switching current in the converter to reduce the output voltage noise at times when the load is being reduced and the load is less than twenty percent of a maximum potential load value.

25. A power converter for providing an output voltage to a load, the power converter comprising:

an input for receiving power from a power source;

a switching circuit that switches the received power based on time-varying control signals;

a compensation circuit associated with the switching circuit, the compensation circuit being configured to increase a zero-voltage switching current in response to a&reduction in the load; and an output terminal to deliver the output voltage to the load.

26. A power converter as in claim 25, wherein the switching circuit includes:

a first set of switches to couple an energy storage device to receive power from the power source based on a first voltage polarity; and a second set of switches to couple the energy storage device to a voltage opposite the first voltage polarity.

27. A power converter as in claim 26, wherein the energy storage device is a transformer.

28. A power converter as in claim 25, wherein the zero-voltage switching circuit includes:

an inductor; and a set of switches coupled to the inductor, the set of switches being switched to produce the zero-voltage switching current from the inductor.

29. A power converter as in claim 25, wherein the switching circuit includes a set of main power switching transistors, and wherein the compensation circuit generating the zero voltage switching current includes:

an inductor; and a set of auxiliary switches coupled to the inductor to generate the zero voltage switching current, switching of the set of auxiliary switches being controlled by at least a portion of the time-varying control signals that drive the set of main power switching transistors.

30. A power converter as in claim 25, wherein the switching circuit includes a first set of main power transistors and a first set of energy storage devices that combine to form at least part of a first clamped-mode series resonant converter, the power converter further comprising:

a second set of main power transistors and a second set of energy storage devices that combine to form at least part of a second clamped-mode series resonant converter that mirrors the first clamped-mode series resonant converter.

31. A power converter as in claim 30, wherein at least one inductor is used to couple the first resonant converter to the second clamped-mode series resonant converter to provide the zero voltage switching current.

32. A power converter as in claim 25, wherein the switching circuit includes a set of main power switching transistors, and wherein the compensation circuit generating the zero-voltage switching circuit includes:

a set of auxiliary transistors that are controlled by at least a portion of the time-varying control signals that drive the set of main power switching transistors, a transistor in the set of auxiliary transistors being of smaller size than the main power switching transistors.

33. A power converter as in claim 25, the switching circuit includes main switching power transistors, each of which has a capacitor disposed in parallel across its output terminals.

34. A power converter as in claim 25, wherein the output voltage is an AC output voltage.

35. A power converter as in claim 25, wherein the time-varying control signals are generated by a phase-shift controller.

36. A power converter as in claim 25, wherein the switching circuit is configured as a full switched bridge circuit.

37. An apparatus for converting power, the apparatus comprising:

an input for receiving power from a power source;

a switching circuit for generating an output voltage to power a load in response to receiving the power; and means for maintaining the output voltage of the switching circuit within a range by increasing an internal compensation current associated with the switching circuit in response to a reduced load condition.

* * * * *